US005749674A

United States Patent [19]

Wilson, Sr.

[11] Patent Number: 5,749,674

[45] Date of Patent: May 12, 1998

[54] METHOD OF PAVEMENT REPAIR

[76] Inventor: Jack H. Wilson, Sr., 3775 Coker Rd., Jackson, Miss. 39213

[21] Appl. No.: 707,449

[22] Filed: Sep. 4, 1996

[51] Int. Cl.[6] ..... E01C 7/32

[52] U.S. Cl. ..... 404/75; 404/82

[58] Field of Search ..... 156/94; 404/72, 404/75, 76, 78, 82

[56] References Cited

U.S. PATENT DOCUMENTS

| | | | |
|---|---|---|---|
| 4,265,563 | 5/1981 | Marzocchi et al. | 404/75 |
| 4,507,013 | 3/1985 | Martinak | 404/75 |
| 4,630,963 | 12/1986 | Wyman | 404/75 |
| 4,659,748 | 4/1987 | Boddie . | |
| 4,781,490 | 11/1988 | Jelling . | |
| 4,948,431 | 8/1990 | Strickland et al. . | |
| 5,183,353 | 2/1993 | Buckelew . | |
| 5,185,013 | 2/1993 | Martin | 156/94 X |
| 5,439,313 | 8/1995 | Blaha et al. | 404/75 |
| 5,464,303 | 11/1995 | Wells . | |
| 5,464,304 | 11/1995 | Dittmar . | |
| 5,476,340 | 12/1995 | Contrasto | 404/75 |
| 5,630,677 | 5/1997 | Barroso | 404/75 |
| 5,660,498 | 8/1997 | Freeman | 404/82 X |

*Primary Examiner*—James Lisehora
*Attorney, Agent, or Firm*—Merek & Voorhees

[57] ABSTRACT

A method of repairing potholes and oil spots in pavement surfaces including removing the deteriorated asphalt, applying a degreaser to the interior of the void, then applying a sealer, filling the void with fiber reinforced concrete which is allowed to set and overlying the fiber reinforced concrete with a polymer fortified cement and applying a waterproof sealer over the entire repair area to create a waterproof sealed patch to the pavement.

12 Claims, 2 Drawing Sheets

METHOD OF PAVEMENT REPAIR

FIELD OF THE INVENTION

This invention relates to repair of pavement damaged by oil as in the case of parking lots and also the repair of potholes.

BACKGROUND OF THE INVENTION

Following the advent pavement for streets, highways, driveways and parking lots came the art of pavement repair. Water, in the form of ice, has long been a malefactor in the destruction of pavement, seeping into joints and cracks, then expanding when it freezes loosening the pavement surface and eventually causing a pothole. Another more recent problem with pavement occurs particularly in asphalt, where oil leaking from automobile engines emulsifies the bituminous material used in asphalt surfaces causing deterioration which allows water to enter the surface.

Prior solutions to pavement repair have included patching potholes with asphalt by directly applying asphalt to the pothole and compressing the surface of the asphalt into the pothole area. Another method of asphalt repair is the repavement of parking lots with a thin layer of asphalt sealant and has been found to be inadequate since the oil spots will tend to emulsify the sealant material from underneath and will shortly expose the surface thereby leaving the problem unresolved. In view of the foregoing, it is believed that there is a need for a new and improved method of pavement repair which avoids the drawbacks of prior methods by providing a cost effective and long lasting repair as herein described.

FEATURES AND SUMMARY OF THE INVENTION

A feature of this invention is to provide a method of repairing potholes in that water is prevented from entering the repaired area from either the pre-existing pavement or from the surface.

A further feature of the invention is to provide a method of repair of oil spots by providing a waterproof water barrier to prevent entry of water into the repaired area either through the pavement material or from the surface.

Yet another feature of the invention is to provide a method pavement repair which employs cementitious material in combination with asphalt pavement.

Still another feature of the invention is to incorporate a water impermeable barrier layer surrounding the patch material both beneath the patch material inside the repaired area and including a layer water impermeable material extending over the patched area.

In summary, the present invention provides a method for repairing pavement including the steps of lining a hole with a water impervious layer, filling the hole with cementitious material, applying a polymer fortified concrete material overlapping the repair area on each side, top and bottom and applying a waterproof sealer to the entire repair area. It may also be desirable to use a power sprayer to remove damaged material and spray the area with a degreaser to remove oil prior to beginning the patch repair process.

DETAILED DESCRIPTION OF THE DRAWINGS

The above and other features and advantages of the invention will be apparent upon consideration of the following detailed description and with reference to the accompanying drawings.

FIGS. 1A–1F is a cross sectional view showing in sequence the repair of an oil spot; and FIGS. 2A–2F is a cross section view showing the sequence of the repair of a pothole in accordance with the invention.

DETAILED DESCRIPTION OF THE INVENTION

Figure 1A:
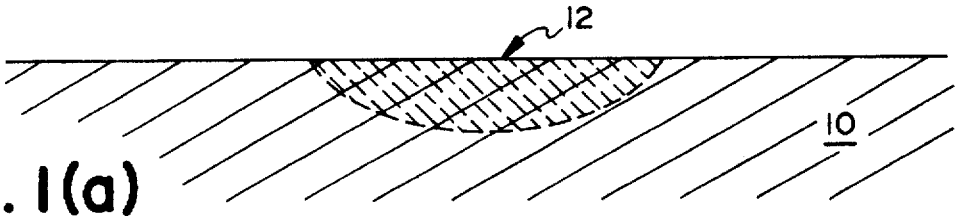

With respect to FIG. 1A, a pavement portion 10 is shown having a deteriorating oil spot 12 forming therein. Oil spots 12 are generally caused by leaking motor oil from automobiles which tends to emulsify the bituminous material used in asphalt creating a soft spongy area. Oil spots primarily occur in parking spaces approximately four feet from the front of the space due to leaking of motor oil from the engine blocks of cars parked in the parking spaces. An oil spot will continue to grow if left unrepaired because the oil will flow into the surrounding pavement.

In accordance with the invention the deteriorated asphalt at the oil spot 12 must be removed. This removal can be done by tools or implements for large chunks of material and also by using a pressure washer having water under pressure at approximately 3200 psi to blow out the damaged pavement and to clean sand and debris from the spot 12.

Figure 1B:
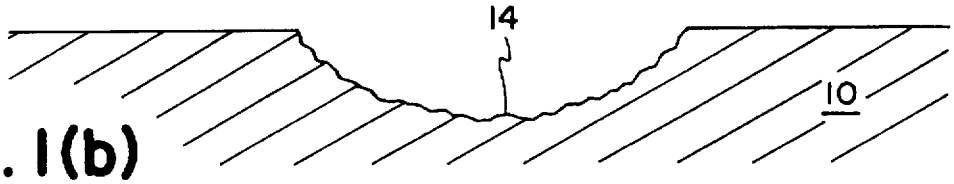

Turning now to FIG. 1B, the surface of the void area 14 of oil spot is sprayed with a degreaser such as SS-200™ to remove any residual oil or emulsified bituminous material. After the degreaser has been allowed to set approximately ten minutes the surface of the void area 14 should be washed thoroughly with a pressure washer to remove any residue caused by the degreaser and the emulsified material.

Figure 1C:
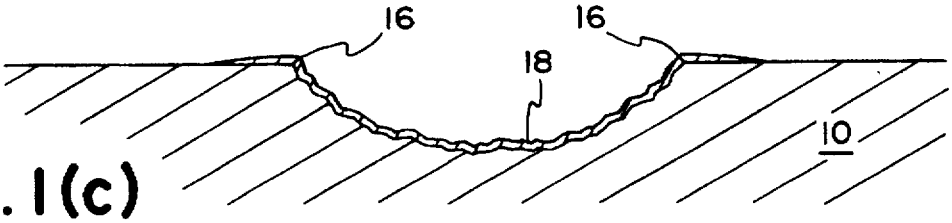

Now turning to FIG. 1C, a waterproof sealer, for example, Enviro-Seal™, should be applied to the surface of the void area 14 overlapping the top edges 16 approximately six inches with the waterproof sealer layer 18.

Figure 1D:
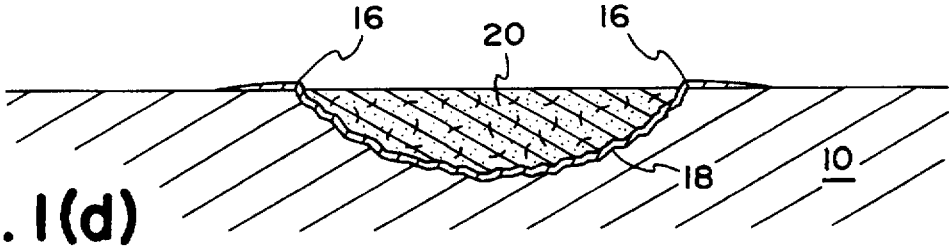
Figure 1E:
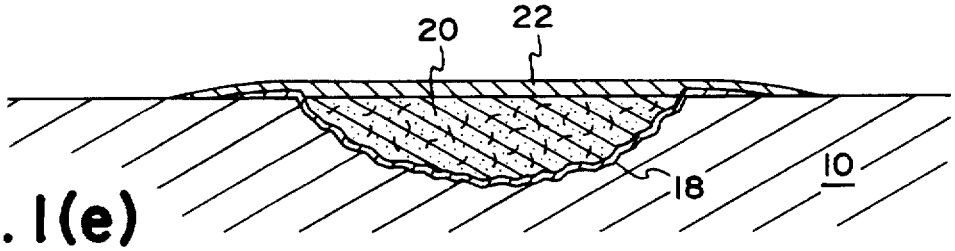

Now that the surface of the void has been prepared and sealed, if the oil spot 12 is over ¾ inches deep a filler of quick setting fiber reinforced concrete, for example, Quickrete™, should be applied to the spot 12 and filled to approximately ⅛ inch from the top as shown in FIG. 1D. Preferably, the fiber-reinforced concrete layer 20 should be allowed to set for 30 minutes to an hour.

Figure 1F:
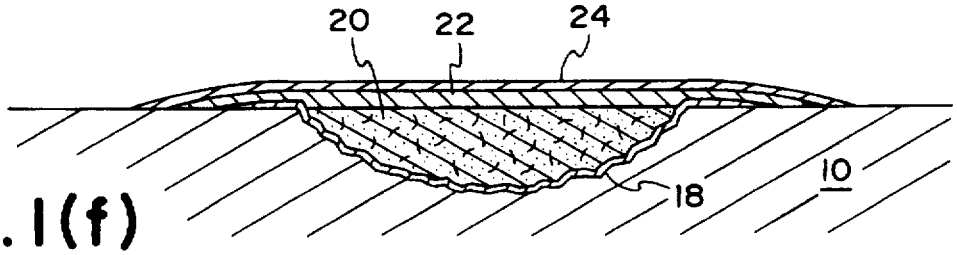

Using a squeegee machine such as the SUPER SQUEEGEE™ pavement coating machine as described in U.S. patent application Ser. No. 08/593,289, incorporated herein by reference, a layer 22 of polymer fortified portland cement should be applied overlapping the quick set concrete by 12 inches on each edge 16. A preferred form of the polymer fortified portland cement coating is sold under the name Enviro-Krete™. Furthermore, if the hole was less than ¾ inch deep to start with, the polymer fortified concrete may be used as the filler material and the quick set concrete may be omitted. After the polymer fortified concrete layer 22 has cured for approximately 24 hours then a solvent based waterproof sealer layer 24 should be applied to the entire repair area as shown in FIG. 1F. Generally a solvent based sealer is preferred because it is impervious to oil and water. Also, a water-borne coating may be used but water-borne coatings to date have not been as effective as the solvent based sealer.

Now with reference to FIG. 2 is a method of pothole repair. In FIG. 2A, a pavement 50 is shown having a pothole or void area 52 and loose or cracked pavement material 54 remaining in the pothole 52. The loose asphalt and sand or dirt 54 should be removed by digging or with a pressure washer if possible to create a clear void 56 as shown in FIG.

Figure 2A:
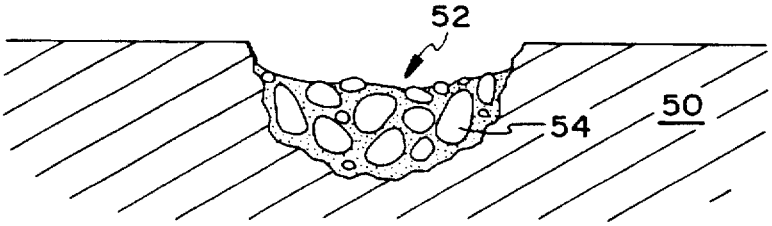
Figure 2B:
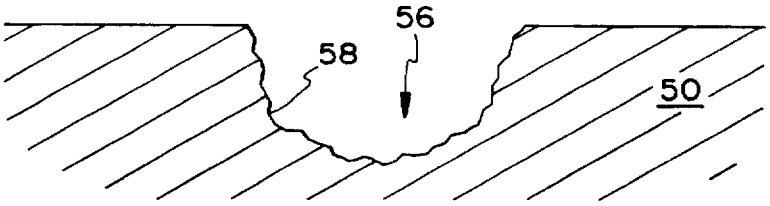
Figure 2C:
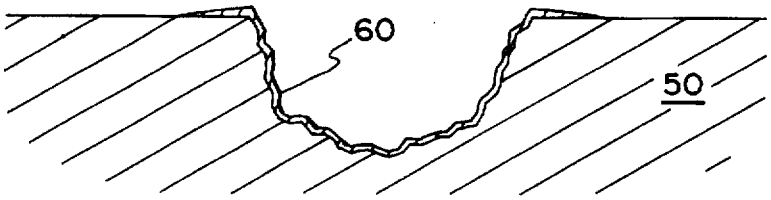
Figure 2D:
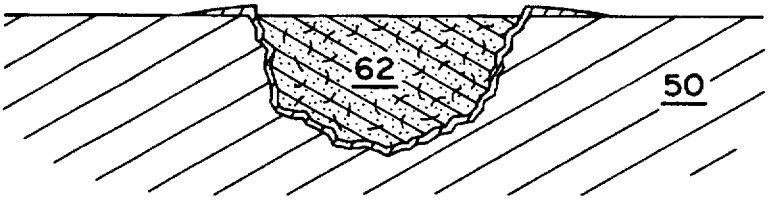
Figure 2E:
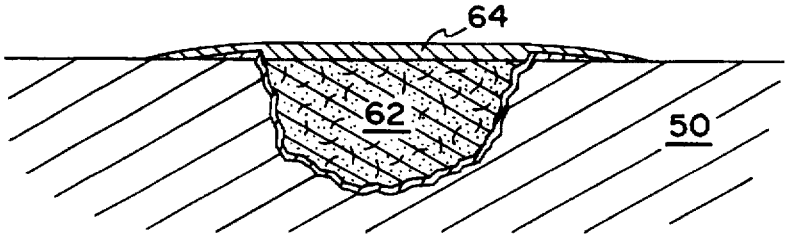
Figure 2F:
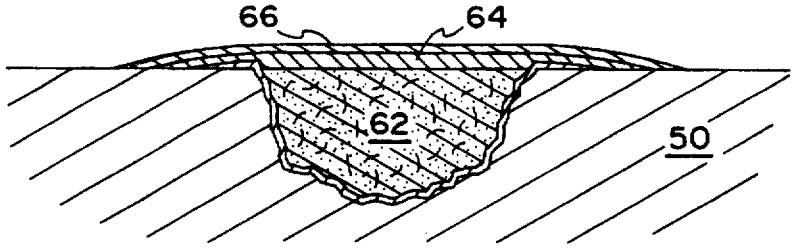

2B. If any oil exists on the walls 58 of the void 56 a degreaser should be applied and washed out thoroughly. After the hole is drying free of moisture the walls 58 of the void 56 are coated with a layer 60 of waterproof sealer as shown in FIG. 2C. Next as shown in FIG. 2D, the void 56 is filled with a layer 62 fiber reinforced concrete and allowed to set for approximately 24 hours. The patched area is then overlayed with a layer 64 of polymer fortified cement at a thickness not to exceed 20 mils using a squeegee machine as previously discussed. The pavement surrounding the patched area is also coated for approximately 12 inches from the void 56. After approximately two hours a waterproof sealer layer 66 is applied to the entire patch area. Following the foregoing steps a completely sealed pothole area is formed which prevents water from entering the repaired area.

While this invention has been described as having a preferred design, it is understood that it is capable of further modifications, uses and/or adaptions of the invention following in general the principle of the invention and including such departures from the present disclosure as come within the known or customary practice in the art to which the invention pertains and as maybe applied to the central features hereinbefore set forth, and fall within the scope of the invention and the limits of the appended claims.

What is claimed is:

1. A method of repairing pavement, comprising the steps of:

a) coating all exposed surfaces of a void in a paved area as well as a portion of the pavement surface surrounding the void with a liquid waterproof material;

b) filling a substantial portion of the void with concrete;

c) allowing the concrete to set for a sufficient period of time;

d) applying a layer of polymer fortified portland cement of sufficient thickness to fill the remaining portion of the void and overlapping the surrounding pavement surface;

e) allowing the layer of polymer fortified portland cement to cure for a sufficient period of time;

f) applying a waterproof sealer layer over the entire repaired area.

2. The method as set forth in claim 1 wherein:

a) filling the void with fiber reinforced concrete to approximately one-eighth of an inch from the surrounding pavement surface.

3. The method as set forth in claim 1 further comprising the step of:

a) removing loose material from the void prior to the step of coating the exposed surfaces.

4. The method as set forth in claim 1 further comprising the step of:

a) applying degreaser to the void.

5. The method as set forth in claim 1 further comprising the step of:

a) washing the void with a pressure washer prior to coating the void with waterproof material.

6. The method as set forth in claim 1 wherein:

a) the polymer fortified cement layer has a thickness of 20 mils.

7. A method of repairing asphalt pavement, comprising the steps of:

a) coating all exposed surfaces of a void in an asphalt paved area as well as a portion of the pavement surface surrounding the void with a waterproof material;

b) applying a layer of polymer fortified portland cement of sufficient thickness to fill the remaining portion of the void and overlapping the surrounding pavement surface;

c) allowing the layer of polymer fortified portland cement to cure for a sufficient period of time;

d) applying a waterproof sealer layer over the entire repaired area.

8. The method as set forth in claim 7 further comprising the step of:

a) removing loose material from the void prior to the step of coating the exposed surfaces.

9. The method as set forth in claim 7 further comprising the step of:

a) applying degreaser to the void.

10. The method as set forth in claim 7 further comprising the step of:

a) washing the void with a pressure washer prior to coating the void with waterproof material.

11. The method as set forth in claim 7 further comprising the step of:

a) substantially filling the void with fiber-reinforced concrete after coating the surfaces of the void with waterproof material.

12. The method as set forth in claim 7 further comprising the step of:

a) substantially filling the void with quickset concrete after coating the surfaces of the void with waterproof material.

* * * * *